United States Patent [19]

Stephens

[11] Patent Number: 4,949,621

[45] Date of Patent: Aug. 21, 1990

[54] LIQUID PROPELLANT GUN

[76] Inventor: Michael L. Stephens, 19163 Beaconsfield, Detroit, Mich. 48224

[21] Appl. No.: 382,779

[22] Filed: Jul. 19, 1989

[51] Int. Cl.[5] ..... F41F 1/04

[52] U.S. Cl. ..... 89/7

[58] Field of Search ..... 89/7

[56] References Cited

U.S. PATENT DOCUMENTS

| | | | |
|---|---|---|---|
| 3,138,990 | 6/1984 | Jukes et al. | 89/7 |
| 3,728,937 | 4/1973 | Nelson | 89/7 |
| 3,992,976 | 11/1976 | Bartels et al. | 89/7 |
| 4,109,557 | 8/1978 | Zaucks | 89/7 |
| 4,148,245 | 4/1979 | Anderson | 89/7 |
| 4,161,133 | 7/1979 | Black et al. | 89/7 |
| 4,164,889 | 8/1979 | Elmore et al. | 89/7 |
| 4,172,408 | 10/1979 | Ayler et al. | 89/7 |
| 4,341,147 | 7/1982 | Mayer | 89/7 |
| 4,478,128 | 10/1984 | Moore | 89/7 |
| 4,653,380 | 3/1987 | Griffing et al. | 89/7 |
| 4,745,841 | 5/1988 | Magoon et al. | 89/7 |
| 4,852,459 | 8/1989 | Bulman | 89/7 |

OTHER PUBLICATIONS

*Liquid Propellant Guns,* W. F. Morrison, J. D. Knapton, and M. J. Bulman, reprinted from *Gun Propulsion Technology,* vol. 109, 1988.

*Primary Examiner*—David H. Brown

*Attorney, Agent, or Firm*—Brooks & Kushman

[57] ABSTRACT

A liquid propellant gun and a method of controlling liquid in a combustion or liquid propellant gun is disclosed. The gun is provided with a barrel attached to the receiver having a cavity formed therein, which is coupled to the barrel or throat. A guide tube coaxially extends through the receiver cavity bisecting the cavity into a main chamber and essential axially passageway. The guide tube has at least one orifice extending therethrough connecting the main chamber to the essential passageway. An elongated pin is telescopically shiftable within the guide tube to load projectiles into a firing position seated in the barrel throat. A projectile, when in the barrel throat defines a prechamber abounded by the guide tube. Liquid propellant is admitted into the chamber and ignited within the prechamber causing the prechamber pressure to rapidly rise forcing hot combustion products into the main chamber and causing the pin to begin to retract. The propellant in the main chamber then burns and the combustion is regulated in part by the pin position.

23 Claims, 5 Drawing Sheets

LIQUID PROPELLANT GUN

FIELD OF THE INVENTION

This invention relates to a liquid propellant gun and more particularly, through guns in which the projectile and the propellant are independently stored and loaded.

BACKGROUND OF THE INVENTION

For over 40 years, various private firms and government agencies have been working to develop a reliable liquid propellant gun. An excellent historical summary of liquid propellant gun research was published by W. F. Morrison, J. D. Knapton and M. J. Bulman, *Liquid Propellant Guns*, Gun Propulsion Technology of Volume 109, 1988, which has been incorporated herein by reference in its entirety. This publication has been incorporated to provide historical background information and is to be regarded as nonessential subject matter. One of the primary attractions to liquid propellant guns are their ability to store projectiles and propellant very compactly with little wasted space. Charges may be varied on an as needed basis to suit the conditions at the time of projectile firing and the propellant can be stored in a remote safe location and is simply transported to the combustion chamber when required.

A wide variety of propellants have been developed over the years. Work has been done with liquid gaseous mixtures; bi-propellants such as a hydrocarbon fuel and an oxygen containing agent, such as hydrogen peroxide, separately metered into and mixed within combustion chamber; and monopropellants, such as hydrazine based propellants or hydroxyl ammonium nitrate (HAN) propellants. While there is still room for improvement in propellant technology, the primary drawback to commercialization of liquid propellant guns is the lack or ability to control combustion sufficiently to achieve ballistic variability consistent with conventional guns using a granular solid propellant.

OBJECTS, FEATURES AND ADVANTAGES OF THE INVENTION

An object of the present invention is to provide a liquid propellant gun which may be repeatedly fired with little shot to shot variation in projectile ballistics.

It is the object of the present invention to provide a method of regulating combustion of a liquid propellant to achieve a predetermined pressure versus a time burn cycle, minimizing the frequency and deviation of fast burn, slow burn cycles.

An object of the present invention is to provide a liquid propellant gun having a small prechamber in which combustion can be consistently initiated which is automatically coupled to a main chamber where the remaining propellant is stored.

Another objection of the present invention is provide a liquid propellant gun in which the projectiles can be automatically loaded axially through the receiver into the barrel throat with minimal complexity and few moving parts.

Yet another objection of the invention to provide a gun having a prechamber in which combustion is initiated which has minimal ullage accumulation thereby minimizing the variability caused during initial flame development.

Other objects, features and advantages of the invention will become readily apparent from a following description in the accompanying drawings.

SUMMARY OF THE INVENTION

Accordingly, a liquid propellant gun of the present invention includes an elongated barrel having a bore formed therethrough with one end having a throat adept for receiving a projectile. A receiver has a cavity formed therein attached to and aligned with the barrel throat. A guide tube coaxially extends through the receiver cavity bisecting the cavity into a main chamber and a center axial passageway which are interconnected by an orifice extending through the tube wall. An elongated pin is telescopically shiftable within the guide tube passageway between a firing position, in which the pin is positioned adjacent a projectile seated in the bore throat, and a recoil position wherein the pin is shifted axially away from the bore. The prechamber defined by the projectile base, the pin first end and the guide tube axial passageway. A mechanism for admitting the propellant into the chamber and a mechanism for igniting the liquid propellant within the prechamber is also provided.

DETAILED DESCRIPTION OF THE PREFERRED EMBODIMENT

Figure 1:
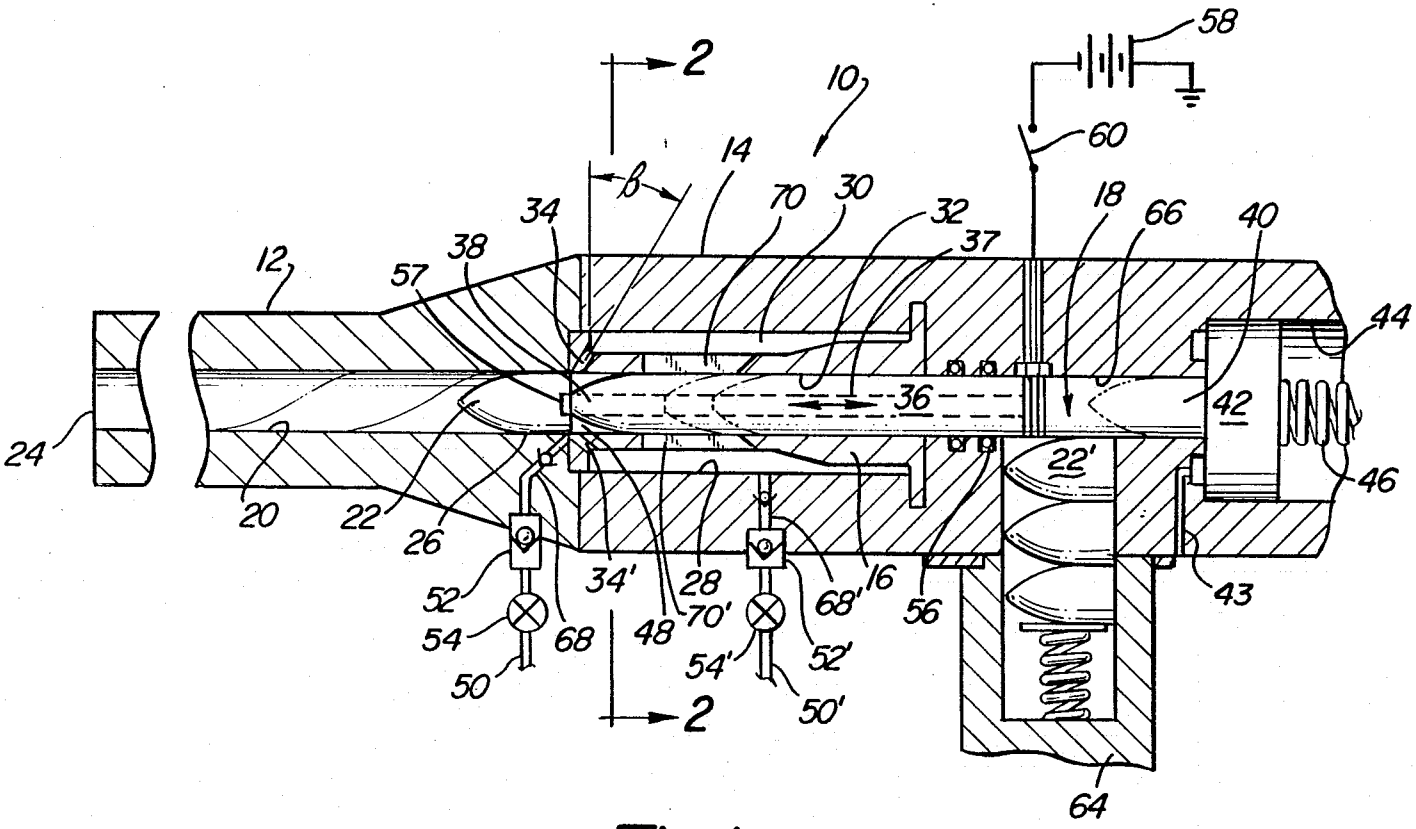
FIG. 1 is a cut away cross-sectional view illustrating the present invention.
Figure 2:
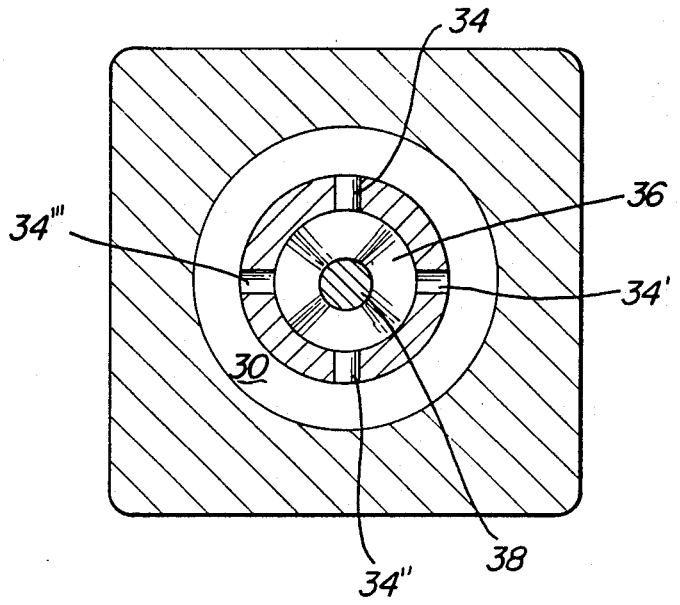
FIG. 2 is a sectional view taken along line 2—2 in FIG. 1.

The preferred embodiment of the invention is illustrated schematically in FIGS. 1 and 2. The liquid propellent gun 10, comprises an elongated barrel 12, a receiver 14, a guide tube 16, and a pin assembly 18. The elongated barrel 12 is provided with an axial bore 20 sized to sealingly cooperate with a projectile 22 to be fired by the gun. Axial bore 20 has two ends, one end providing a muzzle 24 and the other end providing a throat 26 for accepting the projectile 22. The barrel 12 is attached to receiver 14 in a coaxial manner as shown. The receiver is provided with an internal cavity 28 coaxially aligned with the bore 20 and communicating with throat 26. Guide tube 16 coaxially extends through a receiver cavity 28 bisecting the cavity into a main chamber 30 and a central axial passageway defined by the guide tube interior wall surface 32 which is slightly larger than the projectile diameter. At least one orifice, preferably a plurality of orifices 34, 34', 34'' and 34''' extend through guide tube connecting the main chamber with the central axial passageway.

Pin assembly 18 includes elongated pin 36 sized to telescopically fit within the central axial passageway of guide tube 16. Elongated pin 36 has a first and second ends and a central section therebetween. Pin first end 38 is preferably tapered to a small area tip which is adapted to engage the base of projectile 22. When the pin first end is positioned adjacent the projectile seated in the throat, the gun is in the firing position. During and subsequent to combustion, the pin moves to a retracted position shifted axially away from the bore.

Pin 36 is provided with a second end 40 which is affixed to piston 42. Piston 42 slidably cooperates with cylindrical piston cavity 44 formed in the receiver 14. Spring 46 serves to elastically bias the pin assembly toward the barrel to where a pin first end 38 is cooperating with a projectile seated in the bore throat. With the projectile in the bore throat and the pin in the firing position, the projectile base pin first end 38 and guide tube interior wall surface 32 define prechamber 48. The prechamber is coupled to main chamber 30 by orifices 34; and, when the pin 36 is in the firing position, the volume of the prechamber 458 is preferably 0.05 to 0.20 times the volume of the main chamber 30.

When the gun is in the ready-to-fire standby position, a projectile will be loaded in the throat; and the pin first end 38 will be seated against the projectile base as shown in FIG. 1. Immediately prior to firing, a liquid propellant will be admitted into the chamber compressing the combustion product mixture contained therein. The pressure of the liquid propellant will vary depending upon the propellant and the projectile mass. However, the liquid propellant to ullage ratio by volume is preferably in the range of 10:1 to 25:1 and most preferably in the 20:1 to 25:1 range. A mere fraction of a second after the liquid propellant is loaded, the charge is ignited thereby reducing any variation which may result from charge leakage.

In the first embodiment shown in figure one, two ports are shown, 50 and 50', providing means for admitting liquid propellant into the chamber. Port 50 introduces liquid propellant into the prechamber and port 50' introduces liquid propellant into the main chamber. It is possible to use more or less than two ports, however, it is desirable to minimize the ullage within the prechamber. It is highly desirable to introduce sufficient liquid propellant into the prechamber to force any gas bubbles which form ullage into the main chamber. Accumulation of ullage adjacent the point of combustion initiation causes wide variations in the combustion process. Propellant inlet ports 50 and 50' are provided with check valves 52 and 52', and flow control valves 54 and 54' to enable the desired amount of propellant to be metered into the chamber and to securely seal the chamber during combustion. To further aid in sealing, annular seals 56 and 56' mounted in receiver 14 coaxially surround the central portion of pin 36 to prevent leakage.

In the first embodiment shown, each of the projectiles are provided with an electrically ignitable pyrotechnic primer 57 installed in the base. An ignition signal is passed through a conductive central 37 of elongated pin 36 to ignite the primer. Power supply 58 and switch 60 schematically illustrated in FIG. 1 provide an ignition signal to the pin and in turn the primer in the projectile base. It is necessary to suitably insulate the ignition signal from the receiver. The pin can either be formed of a nonconductive ceramic material with a conductive core or, if a metallic pin is utilized, an insulated conductor must be provided which extends a sufficient length to insulate the pin.

After the primer has been ignited, combustion will begin within prechamber 48. As can be seen from diagram of chamber pressure versus time in FIG. 3, chamber pressure (P) arises slowly initially and then begins to quickly spread. This initial period of combustion prior to rapidly increased pressure is referred to as the ignition delay (D). The majority of the variation in cycle to cycle, or shot to shot, combustion pressure is attributable to how the flame initially develops during this delay period. One should also note that initial combustion occurs at a low pressure as the ullage has not yet been compressed.

The use of a relatively small prechamber enables ignition delay to be greatly reduced. A sharp increase in pressure occurs once the flame develops sufficiently to obtain the necessary flame front area, (gas/liquid interface) to achieve the designed rate of combustion. Preferably, orifices 34, 34', 34'' and 34''' which connect the prechamber to a main chamber by a size so as to project a high speed mixture propellant and burning gases into the main chamber to consistently initiate main chamber combustion. Once rapid pressure rise commences, the projectile begins to move down the bore and pin 18 begins to retract. Once combustion begins to take place in the main chamber, the propellant in the prechamber is almost fully consumed and the flow of gases through orifices 34 reverses direction.

Figure 3:
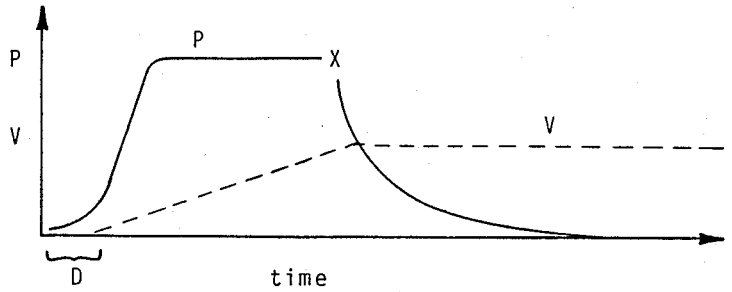
FIG. 3 is a plot of chamber pressure and projectile velocity versus time.

As the pin retracts main chamber ports 70 and 70' which are in the shape of axial slots extending through guide tube 16 are opened connecting the guide tube central passageway to the main chamber. The movement of the pin, the shape of the pin first end, the orientation of the main chamber ports, and the axial position of the pin all effect the degree to which ports 70 and 70' open. Ideally, a pressure curve similar to that shown in FIG. 3 is achieved. In order to achieve a maximum projectile muzzle velocity, it is desirable to maintain the projectile at peak pressure throughout its travel down the bore. Once the projectile exits the muzzle as shown at time x, chamber pressure rapidly decreases as any remaining unburned propellant is consumed and the combustion products flow out the bore.

Figure 5:
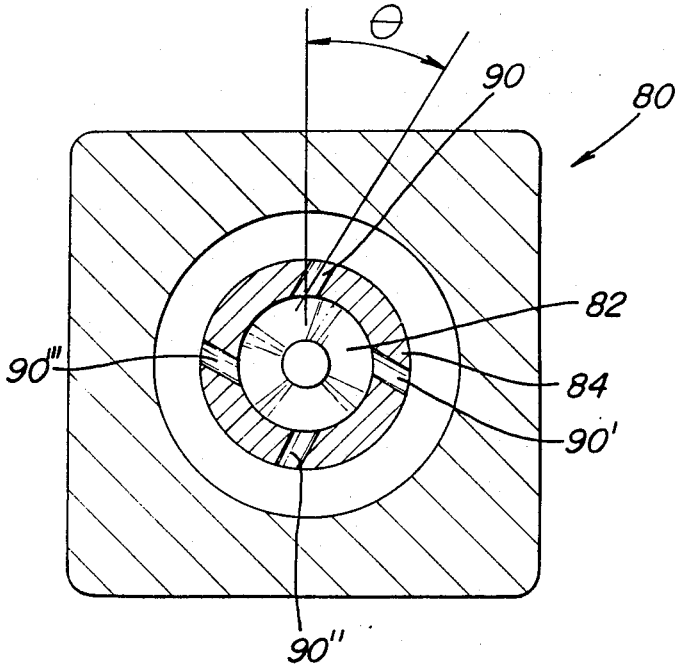
FIG. 5 is a left side cross-sectional view taken along line 5—5 of FIG. 4.

In the ideal scenario shown in FIG. 3, the projectile will accelerate uniformly down the bore reaching peak velocity (V) at the time it exits the muzzle. In order to achieve the necessary rate of combustion to maintain a selected pressure, it is important to not only control combustion initiation, but to maintain the desired flame front area throughout the combustion process. To minimize losses caused by pressure drop between the main chamber and the guide tube axial passageway, the open area of the main chamber ports should be maintained relative to combustion rate so that the port doesn't become a severe obstruction. In the constant pressure versus time, projectile fire occurred shown in FIG. 3, as velocity increases, the rate of combustion must increase proportionally to remain pressure in the ever increasing volume. Peak combustion should occur after the pin has retracted sufficiently so that the main chamber ports are completely open. The barrel port should act as the flow restriction in order to obtain peak performance. Therefore, the area of the orifices and the main chamber port. interconnecting a main chamber and the tube axial passageway should exceed the bore diameter. Ideally, the effective hydraulic diameter of all of the orifices and main chamber ports combined, will exceed the hydraulic diameter of the bore. While it is important to maintain sufficiently large orifice and main chamber port area during combustion to allow the free escape of combustion products, it is also important to maintain a sufficiently small prechamber orifice area so that adequate turbulence can be generated within the main chamber after the propellant in the prechamber is consumed. The total cross-sectional area of the prechamber ports should be not more than 10% of the bore cross-sectional area as illustrated in FIGS. 2 and 5.

The present design utilizing a toroidally shaped chamber enables the flame front area to be controlled. Increasing the outer diameter of the guide tube as shown in FIG. 1 as a function of axial position varies the area of the cavity 28 allowing the flame area to be regulated. Minimal cross-sectional area of the main chamber in the propellant end region provides sufficient quench to prevent auto ignition caused by ullage collapse.

As the combustion process is completed and the projectile has exited the muzzle, the pin will have retracted so that the pin has cleared the main chamber ports, but has not yet cleared seals 56 and 56'. There will be sufficient momentum in the pin assembly and sufficient pressure in the chamber during the blow down to enable the pin assembly to completely retract past magazine 64 to automatically load another projectile 22' into the receiver bore 66. As the pin assembly retracts, spring 46 is compressed. Once a complete pin retraction is achieved, the pin will then immediately return to the firing position loading a new projectile into the throat of the barrel.

In order to minimize cycle to cycle variations, it is important to minimize, and ideally completely eliminate ullage from the prechamber. Ideally, sufficient propellant will be introduced directly into the prechamber by prechamber port 68 in order to flush all gases out of the prechamber before propellant fill is completed. In order to achieve a quick propellant fill the preferred embodiment includes a main chamber propellant inlet. The propellant inlet port sizes must be relatively sized to trap substantially all the ullage in the main chamber.

In order to further enhance combustion during the initial portion of the combustion process, prechamber orifices 34 are inclined rearwardly at an angle B relative to a radial line perpendicular to the bore axis as shown in FIG. 1. The use of a plurality of evenly spaced orifices extending radially and axially around the tube further enhances combustion uniformity. As combustion pressure is rising pin 36 begins to retract, main ports 70 and 70' open interconnecting main chamber 30 will put the guide tube interior coaxially in line with the gun bore. The number and shape of main port 70 and 70' may be varied to achieve the desired rate of combustion.

In order to dampen the movement of the pin 36, piston 42 is utilized to displace air trapped in the cylindrical piston wall cavity 44 formed in the receiver. As a piston moves in either direction, air is compressed and forced to flow through a narrow outlet passageway 43. By restricting the passageways varying amounts of dampening may be provided.

Figure 4:
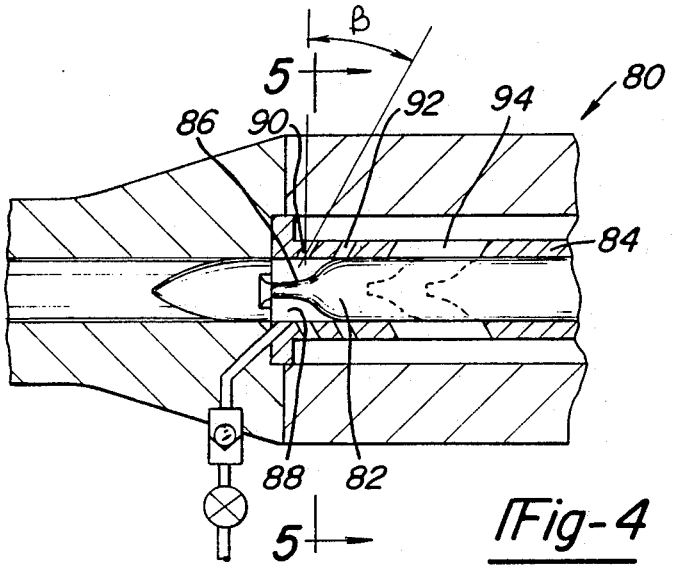
FIG. 4 is a cross-sectional side elevation of a second embodiment of the invention.

FIGS. 4 and 5 illustrate a second embodiment of the liquid propellant gun 80 in which pin 82 and guide tube 84 differ from the first embodiment of the invention. Pin first end 86 is pronouncedly tapered having a relatively small diameter necked down region resulting in a larger prechamber 88 than the first embodiment. It should be appreciated that a wide variety of prechamber volumes and shapes can be achieved by simply modifying the shape of pin first end.

The second embodiment of the invention additionally illustrates the flexibility of the present invention to be configured for various propellants and projectiles. Guide tube 84 is provided with three sets of orifices, prechamber orifices 90, secondary orifices 92 and main ports 94. Prechamber orifices 90 are unobstructed by pin 82. Secondary orifices 92 are initially closed, but open immediately upon pin movement and main ports 94 do not become open until the pin has retracted significantly. The orientation and cross-sectional area of the various orifices can be sized to achieve the desired flame front area and combustion rate necessary to achieve the pressure volume curve sought. As illustrated in the enlarged cross-sectional view of FIG. 5, the ports may be oriented to deviate substantially from radial as indicated by angle $\theta$ in FIG. 5 and when viewed along the bore axis. By uniformly spacing the ports about the tube periphery and inclining them rearwardly at an angle $\delta$ and tangentially at an angle $\theta$ as shown in FIGS. 4 and 5, a controlled swirling motion can be induced in the main chamber during the initial stages of combustion when it is most important to maintain combustion uniformity. By inducing a swirling motion in the main chamber, liquid propellant flame front development is much more uniform and less subject to random cycle to cycle variation.

Figure 6:
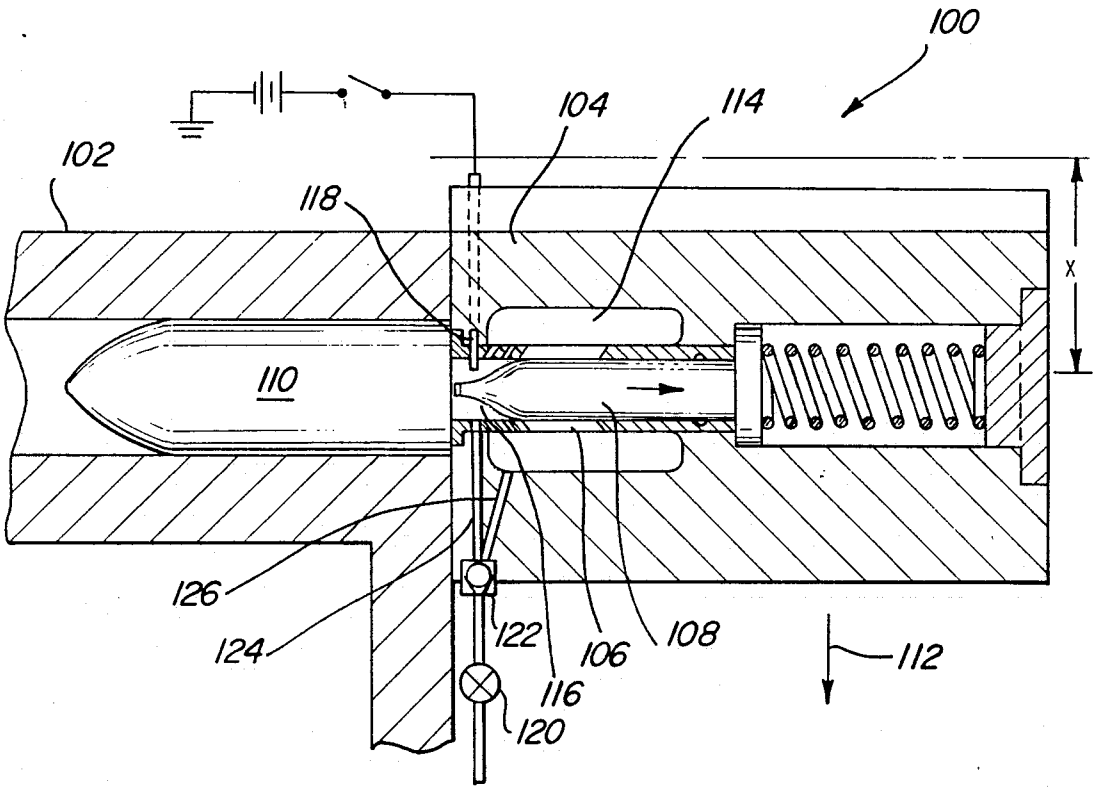
FIG. 6 is a cross-sectional side elevation of a third embodiment of the invention.

FIG. 6 shows a third embodiment of the liquid propellant gun 100. Gun 100 is made up of a barrel 102 and receiver 104, a guide tube 106 and a pin assembly 108. Gun 100 is designed for large caliber projectiles where automatic feeding of the projectile through the guide tube may be impractical to tube space considerations and not necessary to achieve the desired rate of fire. Projectile 110 is loaded by dropping the receiver relative to the barrel and moving the receiver in the direction of arrow 112. The receiver drops relative to the center line of the barrel, a distance x, which is sufficient to allow projectiles to be inserted into the barrel throat. Preferably, a concave groove is formed in the top surface of the receiver to facilitate easy insertion of projectiles into the barrel. With the projectile firmly seated in the throat, the receiver is raised and locked securely in the position shown in FIG. 6 using a conventional falling block mechanism not shown. The cavity within the receiver is bisected by the guide tube defining a main chamber 114 and a prechamber 116. A plurality of orifices extending through the tube coupling the prechamber and main chamber in a manner similar to that previously discussed. The embodiment of the gun as shown in FIG. 6 has the propellant within the prechamber ignited by electrical spark ignited 118 which projects it to prechamber 116. Igniter 118 is activated by a switch and a power supply of known conventional design.

Similar to the first and second embodiment of the invention described previously, the liquid propellant fuel for gun 100 is loaded immediately prior to firing. A fill valve 120 and check valve 122 supply propellant to the prechamber propellant inlet and the main chamber propellant inlet 124 and 126 respectively. Again, the prechamber and main chamber propellant inlets are sized so that the prechamber completely fills, displacing ullage to the main chamber. Once the propellant is filled the igniter is fired and combustion is initiated in the prechamber. Hot combustion products are projected through the prechamber ports into the main chamber as pressure rises and ullage collapses. With increased pressure, pin 108 begins to retract opening the orifices in guide tube 106 interconnecting the main chamber with the interior guide tube. After the projectile has exited the muzzle and the chamber pressure quickly drops to atmosphere pressure and the pin assembly 108 returns to the firing position. The receiver can then be dropped and a new projectile loaded so that the receiver can be returned to the ready to fire position.

Figure 7:
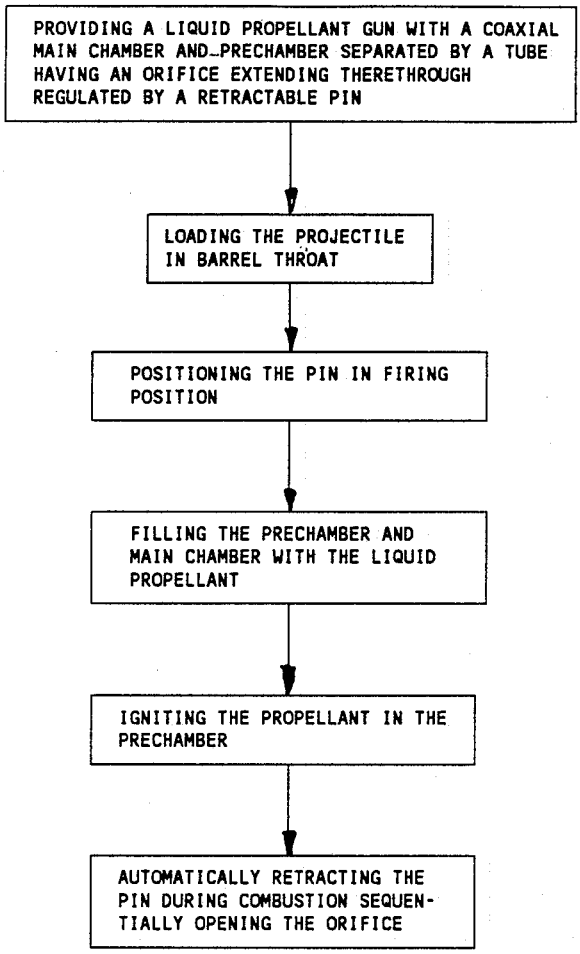
FIG. 7 is a flow chart illustrating the steps in utilizing the method of operation of the various embodiments of the invention.

FIG. 7 provides a flow chart which further illustrates the common steps utilized in the method of operation of the various embodiments of the apparatus shown. The first step is to provide a liquid propellant gun having a coaxial prechamber and main chamber separated by a tube having one or more orifices formed therein. A retracting pin shiftable within the tube to regulate the flow of liquid propellant and combustion products through the orifices during the combustion process. With the gun so provided, the next step is to load a projectile within the barrel throat. The pin is in position in the firing location adjacent to the projectile. Liquid propellant is admitted into the prechamber and main chamber preferably displacing all of the ullage into the main chamber. The liquid propellant is then ignited within the prechamber and combustion is automatically regulated as the pin retracts opening the orifices connecting the main chamber to the guide tube interior. Preferably sufficient propellant is introduced that the propellant occupies between 10 and 25 times more volume than the ullage. In order to maintain a constant amount of propellant from cycle to cycle, it is preferred that propellant be introduced into the chamber using a positive displacement pump.

It should be understood, of course, that while the form of the invention herein shown and described constitutes preferred embodiment of the invention, it is not intended to illustrate all possible forms thereof. It will also be understood that the words used are words of description rather than limitation and various changes may be made without departing from the spirit and scope of the invention disclosed.

What is claimed is:

1. A liquid propellant gun comprising:

an elongated barrel having an axial bore extending therethrough for sealingly cooperating with a projectile to be fired by the gun, said bore having one end providing a muzzle and another end providing a throat for accepting the projectile;

a receiver having a cavity formed therein coaxially aligned with the bore and communicating with said throat;

a guide tube coaxially extending through the receiver cavity bisecting the cavity into a main chamber and a center axial passage, said tube having a tube wall with at least one orifice extending therethrough connecting the main chamber and the central axial passage;

an elongated pin having first and second ends and a central section therebetween telescopically shiftable within the guide tube axial passageway between a firing position with the pin first end positioned adjacent a projectile seated in the bore throat, and a recoil position wherein the pin is shifted axially away from the bore, said pin first end, guide tube axial passageway and the projectile defining a prechamber, which is coupled to a main chamber by said orifice;

means for admitting liquid propellant into the chamber; and means for igniting the liquid propellant within the prechamber causing the pin to shift to the recoil position and combustion to take place within both the guide tube central axial passage and the main chamber.

2. The device of claim 1 further comprising a pin spring elastically biasing the pin to the firing position.

3. The device of claim 1 wherein said pin first end is generally conical in shape.

4. The device of claim 1 wherein the prechamber volume with the pin in the firing position is 0.05 to 0.20 times the main chamber volume.

5. The device of claim 1 wherein said means for admitting liquid propellant comprises a propellant flow valve cooperating with a prechamber inlet port and a main chamber inlet port coupled to the prechamber and the main chamber, respectively.

6. The device of claim 1 wherein said means for admitting liquid propellant further comprises means for admitting liquid propellant into the prechamber and means for admitting liquid propellant into the main chamber to displace substantially all ullage within the prechamber into the main chamber as the propellant is admitted.

7. The device of claim 1 wherein said guide tube center axial passageway has a diameter greater than the projectile to allow new projectiles to be loaded through the guide tube into the bore throat.

8. The device of claim 1 wherein said means for admitting liquid propellant into the chamber further comprise a prechamber inlet port opening into the prechamber.

9. The device of claim 8 wherein said means for admitting liquid propellant further comprises a main chamber and inlet port opening into the main chamber.

10. The device of claim 1 wherein said at least one orifice further comprises a plurality of prechamber orifices extending radially and axially about the guide tube connecting the prechamber to the main chamber.

11. The device of claim 10 wherein said prechamber orifices extend from the prechamber into the main chamber and are inclined at an angle $\delta$ relative to the tube radius away from the barrel.

12. The device of claim 11 wherein said plurality of prechamber orifices are inclined at an angle $\theta$ relative to the guide tube radius when viewed along the tube axis thereby inducing the liquid propellant in the main chamber to swirl during initial combustion.

13. The device of claim 1 wherein said pin in the firing position at least partially obstructs said at least one orifice extending through the guide tube.

14. The device of claim 13 wherein said at least one orifice comprises at least one prechamber orifice connecting the prechamber and main chamber and at least one mainport extending through the guide tube which is obstructed by the bolt in the firing position and connecting to the main chamber to the guide tube axial passageway when the bolt is in the recoil position.

15. The device of claim 13 wherein said at least one orifice comprises a plurality of orifices spaced about the bore, wherein the effective total hydraulic diameter of all of said plurality of orifices excess the hydraulic diameter of the bore when the pin is in the retracted position.

16. The device of claim 13 wherein said at least one orifice comprises a plurality of orifices spaced about the bore, wherein the total cross-sectional area of all of said plurality of orifices exceeds the cross-sectional area of the bore when the pin is in the retracted position.

17. The device of claim 16 wherein the area of said plurality of orifices is not more than 10% of the bore cross-sectional area when the pin is in the firing position.

18. A method of controlling combustion in a liquid propellant gun chamber comprising the following steps:

providing a gun having; a barrel with an axial bore thereby forming a muzzle end and a throat end, a receiver attached to the barrel and having a chamber axially aligned with the bore throat; a guide tube coaxially extending through the chamber and having one or more orifices extending therethrough, and a pin telescopically fitting within guide tube shiftable relative to a guide tube axial passageway;

loading a projectile to be fired into the barrel throat through the guide tube using the pin thereby defining a prechamber which is bounded by the guide tube axial passageway, the projectile and the pin, and a main chamber connected thereto by the one or more orifices bounded by the chamber cavity and the guide tube outer periphery;

elastically biasing the pin to a firing position wherein the bolt at least partially obstructs the one or more orifices extending through the guide tube;

introducing a liquid propellant into the chamber at least partially filling the prechamber and main chamber;

igniting the liquid propellant within the prechamber causing the prechamber pressure to rapidly rise forcing hot combustion products into the main chamber through the one or more orifices and causing the pin to begin to retract;

burning the liquid propellant within the main chamber causing a combustion pressure to propel the projectile of the bore at uniform and predictable speed and further causing the bolt to retract; and automatically loading a new projectile into the barrel throat as the pin returns to the firing position ready for another firing cycle.

19. The method of claim 18 wherein said step of introducing liquid propellant into the chamber further comprises introducing liquid propellant into the prechamber and introducing liquid propellant into the main chamber thereby minimizing ullage accumulation in the prechamber.

20. The method of claim 18 wherein said step of igniting the liquid propellant further comprises electrically igniting pyrothechmic primer oriented in the base of the projectile.

21. The method of claim 18 further the comprising the step of feeding a new projectile into the bore throat through the guide tube axial passageway.

22. The method of claim 15 wherein said step of admitting a liquid propellant further comprises introducing sufficient liquid propellant into the chamber to cause the liquid propellant ullage ratio to be between 10:1 to 25:1.

23. The method of claim 22 wherein said step of introducing liquid propellant into the chamber further comprises minimizing ullage accumulation in the prechamber.

* * * * *

UNITED STATES PATENT AND TRADEMARK OFFICE

CERTIFICATE OF CORRECTION

PATENT NO. : 4,949,621

DATED : August 21, 1990

INVENTOR(S) : Michael L. Stephens

It is certified that error appears in the above-identified patent and that said Letters Patent is hereby corrected as shown below:

On the title page: Abstract, line 7 delete "essential" and insert --central--.

Abstract, line 9, delete "essential" and insert central- "essential" and insert --central.

Column 1, line 59, delete "objection"and insert--object and after "is" insert --to--.

Column 1, Line 64
delete "objection" and insert --object-- and after "invention" insert --is--.

Column 3, Line 18
after "is" insert --to--.

Column 3, Line 56
after "central" insert --core--.

Column 3, line 18, "458" should read --48 --.

UNITED STATES PATENT AND TRADEMARK OFFICE

CERTIFICATE OF CORRECTION

PATENT NO. : 4,949,621

DATED : August 21, 1990

INVENTOR(S) : Michael L. Stephens

It is certified that error appears in the above-identified patent and that said Letters Patent is hereby corrected as shown below:

Column 4, line 59, after "ports" delete --.--.

Column 6, line 16, after "angle" (first occurence), delete "δ" and insert --β--.

Column 8, claim 15, line 58, "excess" should be --exceeds--.

Signed and Sealed this

Thirty-first Day of March, 1992

*Attest:*

HARRY F. MANBECK, JR.

*Attesting Officer*

*Commissioner of Patents and Trademarks*